US008560320B2

(12) United States Patent
Yu

(10) Patent No.: US 8,560,320 B2
(45) Date of Patent: Oct. 15, 2013

(54) SPEECH ENHANCEMENT EMPLOYING A PERCEPTUAL MODEL

(75) Inventor: Rongshan Yu, Singapore (SG)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1061 days.

(21) Appl. No.: 12/531,691

(22) PCT Filed: Mar. 14, 2008

(86) PCT No.: PCT/US2008/003453

§ 371 (c)(1),
(2), (4) Date: Sep. 16, 2009

(87) PCT Pub. No.: WO2008/115445

PCT Pub. Date: Sep. 25, 2008

(65) Prior Publication Data

US 2010/0076769 A1 Mar. 25, 2010

Related U.S. Application Data

(60) Provisional application No. 60/918,986, filed on Mar. 19, 2007.

(51) Int. Cl.
*G10L 21/02* (2013.01)

(52) U.S. Cl.
USPC ..... 704/269; 704/226; 704/233

(58) Field of Classification Search
USPC ..... 704/269, 226, 233
See application file for complete search history.

(56) References Cited

U.S. PATENT DOCUMENTS

| | | | | |
|---|---|---|---|---|
| 6,289,309 | B1 | 9/2001 | deVries | |
| 6,477,489 | B1 | 11/2002 | Lockwood et al. | |
| 2005/0240401 | A1* | 10/2005 | Ebenezer | 704/226 |
| 2005/0278171 | A1* | 12/2005 | Suppappola et al. | 704/227 |
| 2008/0071540 | A1* | 3/2008 | Nakano et al. | 704/251 |

OTHER PUBLICATIONS

Tsoukalas, D., et al., "Speech Enhancement Using Psychoacoustic Criteria", Int'l Conf. on Acoustics, Speech, and Signal Processing, Apr. 27-30, 1993, vol. 2, pp. 359-362.

Virag, Nathalie, Single Channel Speech Enhancement Based on Masking Properties of the Human Auditory System, IEEE Transactions on Speech and Audio Processing, Mar. 1, 1999, vol. 7, No. 2, pp. 126-137.

International Search Report mailed Jun. 30, 2008 from EPO.

* cited by examiner

*Primary Examiner* — Vincent P Harper

(57) ABSTRACT

Speech enhancement based on a psycho-acoustic model is disclosed that is capable of preserving the fidelity of speech while sufficiently suppressing noise including the processing artifact known as "musical noise".

8 Claims, 3 Drawing Sheets

SPEECH ENHANCEMENT EMPLOYING A PERCEPTUAL MODEL

TECHNICAL FIELD

The invention relates to audio signal processing. More particularly, it relates to speech enhancement and clarification in a noisy environment.

INCORPORATION BY REFERENCE

The following publications are hereby incorporated by reference, each in their entirety.

[1] S. F. Boll, "Suppression of acoustic noise in speech using spectral subtraction," *IEEE Trans. Acoust., Speech, Signal Processing*, vol. 27, pp. 113-120, Apr. 1979.

[2] B. Widrow and S. D. Stearns, *Adaptive Signal Processing*. Englewood Cliffs, N.J.: Prentice Hall, 1985.

[3] Y. Ephraim and D. Malah, "Speech enhancement using a minimum mean square error short time spectral amplitude estimator," *IEEE Trans. Acoust., Speech, Signal Processing*, vol. 32, pp. 1109-1121, Dec. 1984.

[4] Y. Ephraim and D. Malah, "Speech enhancement using a minimum mean square error Log-spectral amplitude estimator," *IEEE Trans. Acoust., Speech, Signal Processing*, vol. 33, pp. 443-445, Dec. 1985.

[5] P. J. Wolfe and S. J. Godsill, "Efficient alternatives to Ephraim and Malah suppression rule for audio signal enhancement," *EURASIP Journal on Applied Signal Processing*, vol. 2003, Issue 10, Pages 1043-1051, 2003.

[6] R. Martin, "Spectral subtraction based on minimum statistics," *Proc. EUSIPCO,* 1994, pp. 1182-1185.

[7] E. Terhardt, "Calculating Virtual Pitch," Hearing Research, pp. 155-182, 1, 1979.

[8] ISO/IEC JTC1/SC29/WG11, *Information technology—Coding of moving pictures and associated audio for digital storage media at up to about* 1.5 *Mbit/s—Part*3: *Audio*, IS 11172-3, 1992

[9] J. Johnston, "Transform coding of audio signals using perceptual noise criteria," *IEEE J. Select. Areas Commun.*, vol. 6, pp. 314-323, Feb. 1988.

[10] S. Gustafsson, P. Jax, P Vary, "A novel psychoacoustically motivated audio enhancement algorithm preserving background noise characteristics," *Proceedings of the* 1998 *IEEE International Conference on Acoustics, Speech, and Signal Processing,* 1998. ICASSP '98.

[11] Yi Hu, and P. C. Loizou, "Incorporating a psychoacoustic model in frequency domain speech enhancement," *IEEE Signal Processing Letter*, pp. 270-273, vol. 11, no. 2, Feb. 2004.

[12] L. Lin, W. H. Holmes, and E. Ambikairajah, "Speech denoising using perceptual modification of Wiener filtering," *Electronics Letter*, pp 1486-1487, vol. 38, Nov. 2002.

BACKGROUND ART

We live in a noisy world. Environmental noise is everywhere, arising from natural sources as well as human activities. During voice communication, environmental noises are transmitted simultaneously with the intended speech signal, adversely effecting reception quality. This problem is mitigated by speech enhancement techniques that remove such unwanted noise components, thereby producing a cleaner and more intelligible signal.

Most speech enhancement systems rely on various forms of an adaptive filtering operation. Such systems attenuate the time/frequency (T/F) regions of the noisy speech signal having low Signal-to-Noise-Ratios (SNR) while preserving those with high SNR. The essential components of speech are thus preserved while the noise component is greatly reduced. Usually, such a filtering operation is performed in the digital domain by a computational device such as a Digital Signal Processing (DSP) chip.

Subband domain processing is one of the preferred ways in which such adaptive filtering operations are implemented. Briefly, the unaltered speech signal in the time domain is transformed to various subbands by using a filterbank, such as the Discrete Fourier Transform (DFT). The signals within each subband are subsequently suppressed to a desirable amount according to known statistical properties of speech and noise. Finally, the noise suppressed signals in the subband domain are transformed to the time domain by using the inverse filterbank to produce an enhanced speech signal, the quality of which is highly dependent on the details of the suppression procedure.

An example of a typical prior art speech enhancement arrangement is shown in FIG. 1. The input is generated from digitizing the analog speech signal and contains both clean speech as well as noise. This unaltered audio signal y(n), where n=0,1, . . . ,∞ is the time index, is then sent to an analysis filterbank of filterbank function ("Analysis Filterbank") 12, producing multiple subbands signals, $Y_k(m)$, k=1, . . . , K, m=0,1, . . . ,∞, where k is the subband number, and m is the time index of each subband signal. The subband signals may have lower sampling rates compared with y(n) due to the down-sampling operation in Analysis Filterbank 12. In a suppression rule device or function ("Suppression Rule") 14, the noise level of each subband is then estimated by using a noise variance estimator. Based on the estimated noise level, appropriate suppression gains $g_k$ are determined, and applied to the subband signals as follows:

$$\tilde{Y}_k(m)=g_kY_k(m),\ k=1,\ldots,K. \tag{1}$$

The application of the suppression gains are shown symbolically by multiplier symbol 16. Finally, the subband signals $\tilde{Y}_k(m)$ are sent to a synthesis filterbank or filterbank function ("Synthesis Filterbank") 18 to produce an enhanced speech signal $\tilde{y}(n)$. For clarity in presentation, FIG. 1 shows the details of generating and applying a suppression gain to only one of multiple subband signals (k).

Clearly, the quality of the speech enhancement system is highly dependent on its suppression method. Spectral subtraction (reference [1]), the Wiener filter (reference [2]), the MMSE-STSA (reference [3]), and the MMSE-LSA (reference [4]_) are examples of such previously proposed methods. Suppression rules are designed so that the output is as close as possible to the speech component in terms of certain distortion criteria such as the Mean Square Error (MSE). As a result, the level of the noise component is reduced, and the speech component dominates. However, it is very difficult to separate either the speech component or the noise component from the original audio signal and such minimization methods rely on a reasonable statistical model. Consequently, the final enhanced speech signal is only as good as its underlying statistical model and the suppression rules that derive therefrom.

Nevertheless, it is virtually impossible to reproduce noise-free output. Perceptible residual noise exists because it is extremely difficult for any suppression method to track perfectly and suppress the noise component. Moreover, the suppression operation itself affects the final speech signal as well, adversely affecting its quality and intelligibility. In general, a suppression rule with strong attenuation leads to less noisy output but the resultant speech signal is more distorted.

Conversely, a suppression rule with more moderate attenuation produces less distorted speech but at the expense of adequate noise reduction. In order to balance optimally such opposing concerns, careful trade-offs must be made. Prior art suppression rules have not approached the problem in this manner and an optimal balance has not as yet been attained.

Another problem common to many speech enhancement system is that of "musical noise". (reference [1]). This processing artifact is a byproduct of the subband domain filtering operation. Residual noise components can exhibit strong fluctuations in amplitudes and, if not sufficiently suppressed, are transformed into short, bursty musical tones with random frequencies.

DISCLOSURE OF THE INVENTION

Speech in an audio signal composed of speech and noise components is enhanced. The audio signal is transformed from the time domain to a plurality of subbands in the frequency domain. The subbands of the audio signal are processed in a way that includes adaptively reducing the gain of ones of said subbands in response to a control. The control is derived at least in part from estimates of the amplitudes of noise components in the audio signal (in particular, to the incoming audio samples) in the subband. Finally the processed audio signal is transformed from the frequency domain to the time domain to provide an audio signal having enhanced speech components. The control may be derived, at least in part, from a masking threshold in each of the subbands. The masking threshold is the result of the application of estimates of the amplitudes of speech components of the audio signal to a psychoacoustic masking model. The control may further cause the gain of a subband to be reduced when the estimate of the amplitude of noise components (in an incoming audio sample) in the subband is above the masking threshold in the subband.

The control may also cause the gain of a subband to be reduced such that the estimate of the amplitude of noise components (in the incoming audio samples) in the subband after applying the gain is at or below the masking threshold in the subband. The amount of gain reduction may be reduced in response to a weighting factor that balances the degree of speech distortion versus the degree of perceptible noise. The weighting factor may be a selectable design parameter. The estimates of the amplitudes of speech components of the audio signal may be applied to a spreading function to distribute the energy of the speech components to adjacent frequency subbands.

The above described aspects of the invention may be implemented as methods or apparatus adapted to perform such methods. A computer program, stored on a computer-readable medium may cause a computer to perform any of such methods.

It is an object of the present invention to provide speech enhancement capable of preserving the fidelity of the speech component while sufficiently suppressing the noise component.

It is a further object of the present invention to provide speech enhancement capable of eliminating the effects of musical noise.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BEST MODE FOR CARRYING OUT THE INVENTION

A glossary of acronyms and terms as used herein is given in Appendix A. A list of symbols along with their respective definitions is given in Appendix B. Appendix A and Appendix B are an integral part of and form portions of the present application.

This invention addresses the lack of ability to balance the opposing concerns of noise reduction and speech distortion in speech enhancement systems. Briefly, the embedded speech component is estimated and a masking threshold constructed therefrom. An estimation of the embedded noise component is made as well, and subsequently used in the calculation of suppression gains. To execute a method in accordance with aspects of the invention, the following elements may be employed:

1) an estimate of the noise component amplitude in the audio signal, 2) an estimate of noise variance in the audio signal, 3) an estimate of the speech component amplitude in the audio signal, 4) an estimate of speech variance in the audio signal, 5) a psychoacoustic model, and 6) a calculation of the suppression gain.

The way in which the estimates of elements 1-4 are determined is not critical to the invention.

Figure 1:
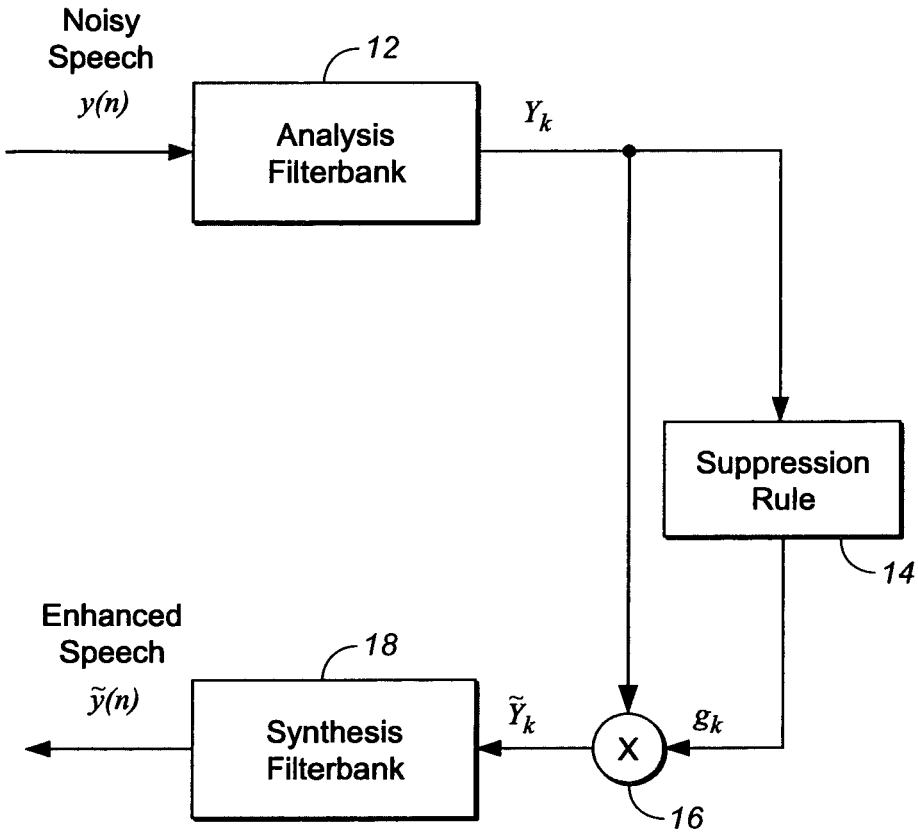
FIG. 1 is a functional block diagram of a generic speech enhancement arrangement.
Figure 2:
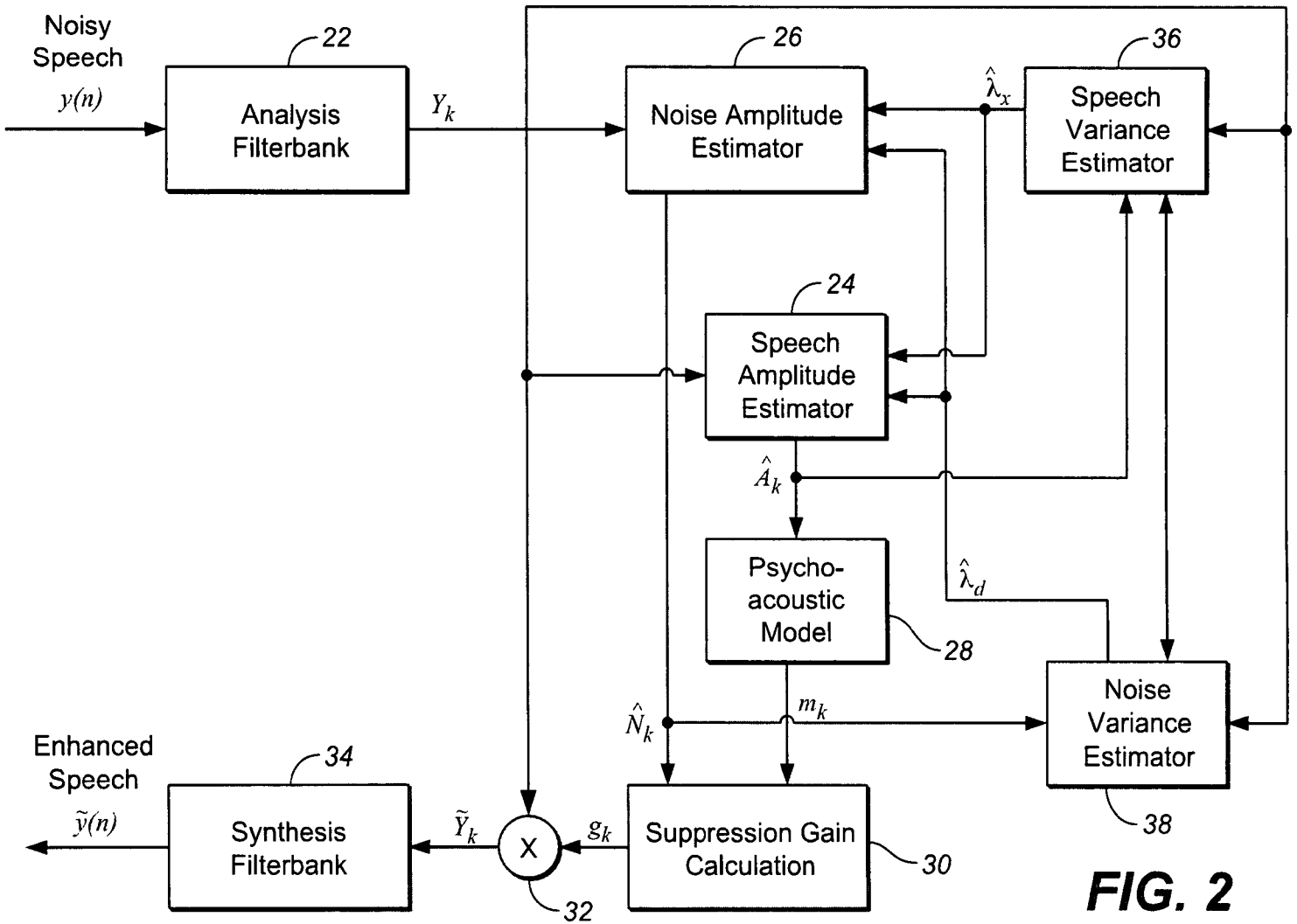
FIG. 2 is a functional block diagram of an example of a perceptual-model-based speech enhancement arrangement according to aspects of the present invention.

An exemplary arrangement in accordance with aspects of the invention is shown in FIG. 2. Here, the audio signal is applied to a filterbank or filterbank function ("Analysis Filterbank") 22, such as a discrete Fourier transform (DFT) in which it is converted into signals of multiple frequency subbands by modulating a prototype low-pass filter with a complex sinusoidal. The subsequent output subband signal is generated by convolving the input signal with the subband analysis filter, then down-sampling to a lower rate. Thus, the output signal of each subband is set of complex coefficients having amplitudes and phases containing information representative of a given frequency range of the input signal.

The subband signals are then supplied to a speech component amplitude estimator or estimator function ("Speech Amplitude Estimator") 24 and to a noise component amplitude estimator or estimator function ("Noise Amplitude Estimator") 26. Because both are embedded in the original audio signal, such estimations are reliant on statistical models as well as preceding calculations. In this exemplary embodiment of aspects of the invention, the Minimum Mean Square Error (MMSE) power estimator (reference [5]) may be used. Basically, the MMSE power estimator first determines the probability distribution of the speech and noise components respectively based on statistical models as well as the unaltered audio signal. The noise component is then determined to be the value that minimizes the mean square of the estimation error.

The speech variance ("Speech Variance Estimation") 36 and noise variance ("Noise Variance Estimation") 38, indicated in FIG. 2 correspond to items 4 and 2, respectively in the above list of elements required to carry out this invention. The invention itself, however, does not depend on the particular details of the method used to obtain these quantities.

A psychoacoustic model ("Psychoacoustic Model") 28 is used to calculate the masking threshold for different frequency subbands by using the estimated speech components as masker signals. Particular levels of the masking threshold may be determined after application of a spreading function that distributes the energy of the masker signal to adjacent frequency subbands.

The suppression gain for each subband is then determined by a suppression gain calculator or calculation ("Suppression Gain Calculation") 30 in which the estimated noise component is compared with the calculated masking threshold. In effect, stronger attenuations are applied to subband signals that have stronger noise components compared to the level of the masking threshold. In this example, the suppression gain for each subband is determined by the amount of the suppression sufficient to attenuate the amplitude of the noise component to the level of the masking threshold. Inclusion of the noise component estimator in the suppression gain calculation is an important step; without it the suppression gain would be driven by the average level of noise component, thereby failing to suppress spurious peaks such as those associated with the phenomenon known as "musical noise".

The suppression gain is then subjected to possible reduction in response to a weighting factor that balances the degree of speech distortion versus the degree of perceptible noise and is updated on a sample-by-sample basis so that the noise component is accurately tracked. This mitigates against over-suppression of the speech component and helps to achieve a better trade-off between speech distortion and noise suppression.

Finally, suppression gains are applied to the subband signals. The application of the suppression gains are shown symbolically by multiplier symbol 32. The suppressed subband signals are then sent to a synthesis filterbank or filterbank function ("Synthesis Filterbank") 34 wherein the time-domain enhanced speech component is generated. An overall flowchart of the general process is shown in FIG. 3.

It will be appreciated that various devices, functions and processes shown and described in various examples herein may be shown combined or separated in ways other than as shown in the figures herein. For example, when implemented by computer software instruction sequences, all of the functions of FIGS. 2 and 3 may be implemented by multithreaded software instruction sequences running in suitable digital signal processing hardware, in which case the various devices and functions in the examples shown in the figures may correspond to portions of the software instructions.

Figure 3:
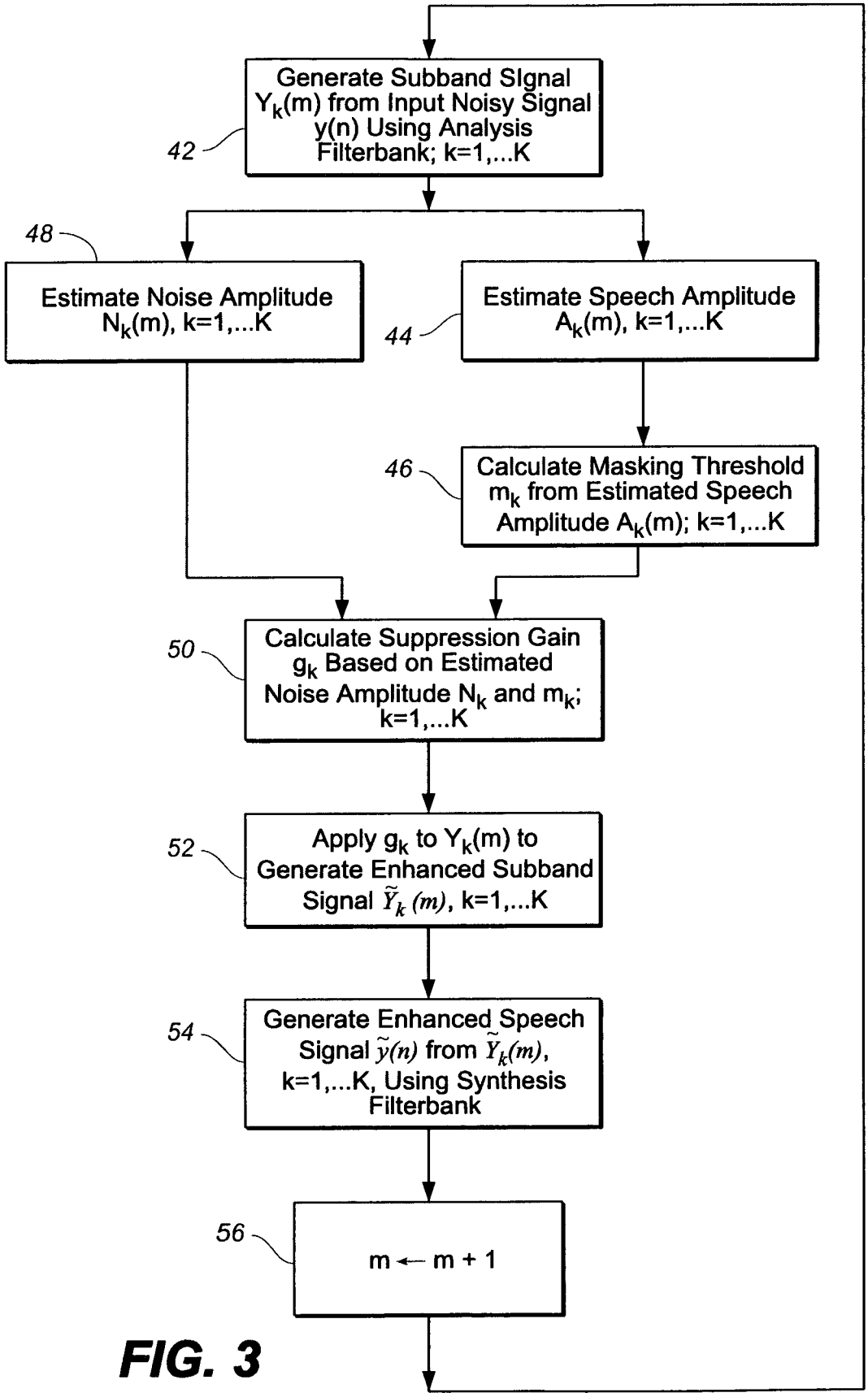
FIG. 3 is a flowchart useful in understanding the operation of the perceptual-model-based speech enhancement of FIG. 2.

Estimation of Speech and Noise Components (FIG. 3, 44, 48)

The input signal input to the exemplary speech enhancer in accordance with the present invention is assumed to be a linear combination of a speech component x(n), and a noise component d(n)

$$y(n)=x(n)+d(n) \tag{1}$$

where n=0,1,2, . . . is the time index. Analysis Filterbank 22 (FIG. 2) transforms the input signal into the subband domain as follows ("Generate subband signal $Y_k(m)$ from noisy input signal y(n) using analysis filterbank, k=1, . . . ,K") 42 (FIG. 3):

$$Y_k(m)=X_k(m)+D_k(m),\ k=1,\ldots,K,\ m=0,1,2, \tag{2}$$

where m is the time index in the subband domain, k is the subband index, respectively, and K is the total number of the subbands. Due to the filterbank transformation, subband signals usually have a lower sampling rate than the time-domain signal. In this exemplary embodiment, a discrete Fourier transform (DFT) modulated filterbank is used. Accordingly, the output subband signals have complex values, and can be further represented as:

$$Y_k(m)=R_k(m)\exp(j\Theta_k(m)) \tag{3}$$

$$X_k(m)=A_k(m)\exp(j\alpha_k(m)) \tag{4}$$

and $$D_k(m)=N_k(m)\exp(j\phi_k(m)) \tag{5}$$

where $R_k(m)$, $A_k(m)$ and $N_k(m)$ are the amplitudes of the audio input, speech component and noise component, respectively, and $\Theta_k(m)$, $\alpha_k(m)$ and $\phi_k(m)$ are their phases. For conciseness, the time index m is dropped the subsequent discussion.

Assuming the speech component and the noise component are uncorrelated zero-mean complex Gaussians having variances of $\lambda_x(k)$ and $\lambda_d(k)$, respectively, it is possible to estimate the amplitudes of both components for each incoming audio sample based on the input audio signal. Expressing the estimated amplitude as:

$$\hat{A}_k=G(\xi_k,\gamma_k)\cdot R_k \tag{6}$$

various estimators for the speech component have been previously proposed in the literature. An incomplete list of possible candidates for the gain function $G(\xi_k,\gamma_k)$ follows.

1. The MMSE STSA (Minimum-Mean-Square-Error Short-Time-Spectral-Amplitude) estimator introduced in reference [3]:

$$G_{STSA}(\xi_k,\gamma_k)=\frac{\sqrt{\pi\upsilon_k}}{2\gamma_k}\left[(1+\upsilon_k)I_0\left(\frac{\upsilon_k}{2}\right)+\upsilon_k I_1\left(\frac{\upsilon_k}{2}\right)\right]\exp\left(\frac{-\upsilon_k}{2}\right) \tag{7}$$

2. The MMSE Spectral power estimator introduced in reference [5]:

$$G_{SP}(\xi_k,\gamma_k)=\sqrt{\frac{\xi_k}{1+\xi_k}\left(\frac{1+\upsilon_k}{\gamma_k}\right)}. \tag{8}$$

3. Finally, the MMSE log-STSA estimator introduced in reference [4]:

$$G_{log\text{-}STSA}(\xi_k,\gamma_k)=\frac{\xi_k}{1+\xi_k}\exp\left\{\frac{1}{2}\int_{\upsilon_k}^{\infty}\frac{e^{-t}}{t}\,dt\right\} \tag{9}$$

In the above, the following definitions have been used:

$$\upsilon_k=\frac{\xi_k}{1+\xi_k}\gamma_k \tag{10}$$

-continued $$\xi_k = \frac{\lambda_x(k)}{\lambda_d(k)} \tag{11}$$

and $$\gamma_k = \frac{R_k^2}{\lambda_d(k)} \tag{12}$$

where $\xi_k$ and $\gamma_k$ are usually interpreted as the a priori and a posteriori signal-to-noise ratios (SNR), respectively. In other words, the "a priori" SNR is the ratio of the assumed (while unknown in practice) speech variance (hence the name "a priori) to the noise variance. The "a posteriori" SNR is the ratio of the square of the amplitude of the observed signal (hence the name "a posteriori") to the noise variance.

In this model construct, the speech component estimators described above can be used to estimate the noise component in an incoming audio sample by replacing the a priori SNR $\xi_k$ with $$\xi'_k = \frac{\lambda_d(k)}{\lambda_x(k)}$$

and the a posteriori SNR $\gamma_k$ with $$\gamma'_k = \frac{R_k^2}{\lambda_x(k)}$$

in the gain functions. That is, $$\hat{N}_k = G_{XX}(\xi'_k, \gamma'_k) \cdot R_k \tag{13}$$

where $G_{xx}(\xi_k, \gamma_k)$ is any one of the gain functions described above. Although it is possible to use other estimators, the MMSE Spectral power estimator is employed in this example to estimate the amplitude of the speech component $\hat{A}_k$ and the noise component $\hat{N}_k$.

Speech Variance Estimation and Noise Variance Estimation (FIG. 2, 36, 38)

In order to calculate the above gain functions, the variances $\lambda_x(k)$ and $\lambda_d(k)$ must be obtained from the subband input signal $Y_k$. This is shown in FIG. 2 (Speech Variance Estimation 36 and Noise Variance Estimation 38). For stationary noise, $\lambda_d(k)$ are readily estimated from the initial "silent" portion or the transmission, i.e., before the speech onset. For non-stationary noise, estimation of $\lambda_d(k)$ can be updated during the pause periods or by using the minimum-statistics algorithm proposed in reference [6]. Estimation of $\lambda_x(k)$ may be updated for each time index m according to the decision-directed method proposed in reference [3]:

$$\hat{\lambda}_x(k) = \mu \hat{A}_k^2(m-1) + (1-\mu)\max(R_k^2(m)-1, 0) \tag{14}$$

where $0<\mu<1$ is a pre-selected constant.

The above ways of estimating the amplitudes of speech and noise components are given only as an example. Simpler or more sophisticated models may be employed depending on the application. Multiple microphone inputs may also be used to obtain a better estimation of the noise amplitudes.

Calculation of the Masking Threshold (FIG. 3, 46)

Once the amplitudes of the speech component have been estimated, the associated masking threshold can be calculated using a psychoacoustic model. To illustrate the method, it is assumed that the masker signals are pure tonal signals located at the center frequency of each subband, and have amplitudes of $\hat{A}_k$, k=1, . . . , K. Using this simplification, the following procedure for calculating the masking threshold $m_k$ for each subband is derived:

1. Speech power is converted to the Sound Pressure Level (SPL) domain according to $$P_M(k) = PN + 10\log_{10}(\hat{A}_k^2),\ k=1, \ldots, K \tag{15}$$

where the power normalization term PN is selected by assuming a reasonable playback volume.

2. The masking threshold is calculated from individual maskers:

$$T_M(i, j) = P_M(j) - 0.275z(f_j) + SF(i, j) - SMR_{i,\ j=1, \ldots, K} \tag{16}$$

where $f_i$ denotes the center frequency of subband j in Hz. $z(f)$ denotes the linear frequency $f$ to Bark frequency mapping according to:

$$z(f) = 13\arctan(0.00076f) + 3.5\arctan\left[\left(\frac{f}{7500}\right)^2\right]_{(Bark)} \tag{17}$$

and SF(i, j) is the spreading function from subband j to subband i. For example, the spreading function given in ISO/IEC MPEG-1 Audio Psychoacoustic Model I (reference [8]) is as follows:

$$SF(i, j) = \begin{cases} 17\Delta_z - 0.4P_M(j) + 11, & -3 \le \Delta_z < -1 \\ [0.4P_M(j) + 6]\Delta_z, & -1 \le \Delta_z < 0 \\ -17\Delta_z, & 0 \le \Delta_z < 1 \\ [0.15P_M(j) - 17]\Delta_z - 0.15P_M(j), & 1 \le \Delta_z < 8 \end{cases} \tag{18}$$

where the maskee-masker separation in Bark $\Delta_z$ is given by:

$$\Delta_z = z(f_i) - z(f_j) \tag{19}$$

3. The global masking threshold is calculated. Here, the contributions from all maskers are summed to produce the overall level of masking threshold for each subband k=1, . . . , K:

$$T(k) = \sum_{l=1}^{M} 10^{0.1T_M(k,l)} \tag{20}$$

The obtained masking level is further normalized:

$$T'(k) = \frac{T(k)}{\sum_{l=1}^{M} 10^{0.1SF(k,j)}} \tag{21}$$

The normalized threshold is combined with the absolute hearing threshold (reference [7]) to produce the global masking threshold as follows:

$$T_g(k) = \max\{T_q(k), 10\log_{10}(T'(k))\} \tag{22}$$

where $T_q(k)$ is the absolute hearing threshold at center frequency of subband k in SPL. Finally, the global masking threshold is transformed back to the electronic domain:

$$m_k = 10^{0.1[T_g(k) - PN]}. \tag{23}$$

The masking threshold $m_k$ can be obtained using other psychoacoustic models. Other possibilities include the psychoacoustic model I and model II described in (reference [8]), as well as that described in (reference [9]).

Calculation of Suppression Gain (FIG. 3, 50)

The values of the suppression gain $g_k$, k=1, . . . , K for each subband determine the degree of noise reduction and speech distortion in the final signal. In order to derive the optimal suppression gain, a cost function is defined as follows:

$$C_k = \beta_k \underbrace{[\log_{10} A_k - \log_{10} g_k A_k]^2}_{\text{speech distortion}} + \underbrace{\max\left[\left(\log_{10} g_k \hat{N}_k - \frac{1}{2}\log_{10} m_k\right), 0\right]^2}_{\text{perceptible noise}} \quad (24)$$

The cost function has two elements as indicated by the underlining brackets. The term labeled "speech distortion" is the difference between the log of speech component amplitudes before and after application of the suppression gain $g_k$. The term labeled "perceptible noise" is the difference between the log of the masking threshold and the log of the estimated noise component amplitude after application of the suppression gain $g_k$. Note that the "perceptible noise" term vanishes if the log of the noise component goes below the masking threshold after application of the suppression gain.

The cost function can be further expressed as $$C_k = \beta_k \underbrace{[\log_{10} g_k]^2}_{\text{speech distortion}} + \underbrace{\max\left[\left(\log_{10} g_k \hat{N}_k - \frac{1}{2}\log_{10} m_k\right), 0\right]^2}_{\text{perceptible noise}} \quad (25)$$

The relative importance of the speech distortion term versus the perceptible noise term in Eqn. (25) is determined by the weighting factor $\beta_k$ where:

$$0 \le \beta_k < \infty \quad (26)$$

The optimal suppression gain minimizes the cost function as expressed by Eqn. (25).

$$g_k = \underset{g_k}{\operatorname{argmin}} C_k \quad (27)$$

The derivative of $C_k$ with respect to $\beta_k$ is set equal to zero and the second derivative is verified as positive, yielding the following rule:

$$g_k = \begin{cases} (m_k / \hat{N}_k^2)^{\frac{1}{2(1+\beta_k)}} & m_k < \hat{N}_k^2 \\ 1 & \text{otherwise} \end{cases} \quad (28)$$

Eqn. (28) can be interpreted as follows: assuming $G_k$ is the suppression gain that minimizes the cost function $C_k$ with $\beta_k$=0, i.e. corresponding to the case wherein speech distortion is not considered:

$$G_k = \begin{cases} (m_k / \hat{N}_k^2)^{\frac{1}{2}} & m_k < \hat{N}_k^2 \\ 1 & \text{otherwise} \end{cases} \quad (29)$$

Clearly, since $G_k^2 \times N_k^2 \le m_k$, the power of the noise in the subband signal after applying $G_k$ will be not larger than the masking threshold. Hence, it will be masked and become inaudible. In other words, if speech distortion is not considered, i.e. the "speech distortion" term in Eqn. (25) is zero by virtue of $\beta_k$=0, then $G_k$ is the optimal suppression gain necessary to suppress the unmasked noise component to or below the threshold of audibility.

However, if speech distortion is considered, then $G_k$ may no longer be optimal and distortion may result. In order to avoid this, the final suppression gain $g_k$ is further modified by an exponential factor 80 $_d$(m).in which a weighting factor $\beta_k$ balances the degree of speech distortion against the degree of perceptible noise (see equation 25). Weighting factor $\beta_k$ may be selected by a designer of the speech enhancer. It may also be signal dependent. Thus, the weighting factor $\beta_k$ defines the relative importance between the speech distortion term and noise suppression term in Eqn. (25), which, in turn, drives the degree of modification to the "non-speech" suppression gain of Eqn. (29). In other words, the larger the value of $\beta_k$, the more the "speech distortion" dominates the determination of the suppression gain $g_k$.

Consequently, $\beta_k$ plays an important role in determining the resultant quality of the enhanced signal. Generally speaking, larger values of $\beta_k$ lead to less distorted speech but more residual noise. Conversely, a smaller value of $\beta_k$ , eliminates more noise but at the cost of more distortion in the speech component. In practice, the value of $\beta_k$ may be adjusted as needed.

Once $g_k$ is known, the enhanced subband signal can be obtained ("Apply $g_k$ to $Y_k$(m) to generate enhanced subband signal $\tilde{Y}_k$(m); k=1, . . . K") 52:

$$\tilde{Y}_k(m) = g_k Y_k(m), k=1, \ldots, K. \quad (30)$$

The subband signals $\tilde{Y}_k$(m) are then available to produce the enhanced speech signal $\tilde{y}$(n) ("Generate enhanced speech signal $\tilde{y}$(n) from $\tilde{Y}_k$(m); k=1, . . . K, using synthesis filterbank") 54. The time index m is then advanced by one ("m←m+1" 56) and the process of FIG. 3 is repeated.

Implementation

The invention may be implemented in hardware or software, or a combination of both (e.g., programmable logic arrays). Unless otherwise specified, the processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

Appendix A

Glossary of Acronyms and Terms

DFT Discrete Fourier Transform
DSP Digital Signal Processing
MSE Mean Square Error
MMSE-STSA Minimum MSE Short Time Spectral Amplitude
MMSE-LSA Minimum MSE Log-Spectral Amplitude
SNR Signal to Noise ratio
SPL Sound Pressure level
T/F time/frequency

Appendix B

List of Symbols y(n), n=0,1, . . . ,∞ digitized time signal
$\tilde{y}(n)$ enhanced speech signal
$Y_k(m)$ subband signal k
$\tilde{Y}_k(m)$ enhanced subband signal k
$X_k(m)$ speech component of subband k
$D_k(m)$ noise component of subband k
$g_k$ suppression gain for subband k
$R_k(m)$ noisy speech amplitude
$\Theta_k(m)$ noisy speech phase
$A_k(m)$ speech component amplitude
$\hat{A}_k(m)$ estimated speech component amplitude
$\alpha_k(m)$ speech component phase
$N_k(m)$ noise component amplitude
$\hat{N}_k(m)$ estimated noise component amplitude
$\phi_k(m)$ noise component phase
$G(\xi_k, \gamma_k)$ gain function
$\lambda_x(k)$ speech component variance
$\hat{\lambda}_x(k)$ estimated speech component variance
$\lambda_d(k)$ noise component variance
$\hat{\lambda}_d(k)$ estimated noise component variance
$\xi_k$ a priori speech component-to-noise ratio
$\gamma_k$ a posteriori speech component-to-noise ratio
$\xi'_k$ a priori noise component-to-noise ratio
$\gamma'_k$ a posteriori noise component-to-noise ratio
μ pre-selected constant
$m_k$ masking threshold
$P_M(k)$ SPL signal for subband k
PN power normalization term
$T_M(i, j)$ matrix of non-normalized masking thresholds
$f_j$ center frequency of subband j in Hz
$z(f_i)$ linear frequency to Bark frequency map function
SF(i, j) spreading function for subband j to subband i
$\Delta_z$ maskee-masker separation in Bark
T(k) non-normalized masking function for subband k
T'(k) normalized masking function for subband k
$T_g(k)$ global masking threshold for subband k
$T_q(k)$ absolute hearing threshold in SPL for subband k
$C_k$ cost function
$\beta_k$ adjustable parameter of the cost function

The invention claimed is:

1. A method for enhancing speech components of an audio signal composed of speech and noise components, comprising transforming the audio signal from the time domain to a plurality of subbands in the frequency domain, processing subbands of the audio signal, said processing including adaptively reducing the gain of ones of said subbands in response to a control, wherein the control is derived at least in part from estimates of the amplitudes of noise components of the audio signal in said ones of the subbands, and wherein the gain minimizes the following cost function for each subband k of said ones of the subbands:

$$C_k = \beta_k[\log_{10} g_k]^2 + \max\left[\left(\log_{10} g_k \hat{N}_k - \frac{1}{2}\log_{10} m_k\right), 0\right]^2$$

wherein $[\log_{10} g_k]^2$ represents a speech distortion term and max $$\left[\left(\log_{10} g_k \hat{N}_k - \frac{1}{2}\log_{10} m_k\right), 0\right]^2$$

represents a perceptible noise term, and wherein $\beta_k$ represents a weighting factor with $0 \le \beta < \infty$, and $g_k$ represents the gain, $m_k$ represents a masking threshold resulting from the application of estimates of the amplitudes of speech components of the audio signal to a psychoacoustic masking model, and $\hat{N}_k$ represents an estimated noise component amplitude, and transforming the processed audio signal from the frequency domain to the time domain to provide an audio signal in which speech components are enhanced.

2. A method according to claim 1 wherein the control causes the gain of a subband to be reduced when the estimate of the amplitude of noise components in the subband is above the masking threshold in the subband.

3. A method according to claim 2 wherein the control causes the gain of a subband to be reduced such that the estimate of the amplitude of noise components after applying the gain change is at or below the masking threshold in the subband.

4. A method according to claim 2 or claim 3 wherein the amount of gain reduction is reduced in response to a weighting factor that balances the degree of speech distortion versus the degree of perceptible noise.

5. A method according to claim 4 wherein said weighting factor is a selectable design parameter.

6. A method according to claim 1 wherein the estimates of the amplitudes of speech components of the audio signal have been applied to a spreading function to distribute the energy of the speech components to adjacent frequency subbands.

7. Apparatus adapted to perform the method of claim 1.

8. A computer program, stored on a non-transitory computer-readable medium for causing a computer to perform the methods of claim 1.

* * * * *